US005730549A

United States Patent [19]

Choudin et al.

[11] Patent Number: 5,730,549

[45] Date of Patent: Mar. 24, 1998

[54] METHOD AND DEVICE FOR REINFORCING THE GROUND USING FIBROUS ADDITIVES

[75] Inventors: Claude Choudin, St Jean D'Arvey; Jean-Pierre Ghiretti, Chambery; Jean-Baptiste Rieunier, Nogent; Jean Boulant, Bailleval, all of France

[73] Assignee: ORGEL, Courbevoie, France

[21] Appl. No.: 566,990

[22] Filed: Dec. 4, 1995

[30] Foreign Application Priority Data

Dec. 2, 1994 [FR] France ..... 94 14509

[51] Int. Cl.[6] ..... E01C 7/36

[52] U.S. Cl. ..... 404/75; 404/76

[58] Field of Search ..... 404/75, 76, 92, 404/100; 172/68, 71, 177, 178

[56] References Cited

U.S. PATENT DOCUMENTS

| | | | |
|---|---|---|---|
| 2,138,904 | 12/1938 | Carswell | 404/92 |
| 3,598,027 | 8/1971 | Swisher, Jr. | 404/76 |
| 4,727,096 | 2/1988 | Choudin | 523/217 |
| 4,748,977 | 6/1988 | Guyot et al. | 128/156 |
| 4,911,789 | 3/1990 | Rieuner et al. | 162/156 |
| 4,990,025 | 2/1991 | Young et al. | 404/92 |
| 5,145,285 | 9/1992 | Fox et al. | 404/70 |
| 5,318,226 | 6/1994 | Kime et al. | 239/1 |

*Primary Examiner*—James Lisehora

*Attorney, Agent, or Firm*—Oblon, Spivak, McClelland, Maier & Neustadt, P.C.

[57] ABSTRACT

A method for reinforcing materials already in place in the ground using fibrous additives.

14 Claims, 5 Drawing Sheets

METHOD AND DEVICE FOR REINFORCING THE GROUND USING FIBROUS ADDITIVES

The invention relates to techniques for reinforcing the ground using fibrous additives and more particularly to a method and to a device making it possible to introduce determined quantities of discrete fibres into ground which has been loosened for this purpose and to mix them together uniformly.

BACKGROUND OF THE INVENTION

When the ground or land is to be processed to some depth to make it more stable, to dry it out, to prepare it to accept the circulation of heavily laden vehicles, or for it to be capable of receiving the surface layers of a roadway, it is desirable to be able to make almost exclusive use of the constituent materials, with a minimum addition of sand or gravel from another origin. In contrast it is accepted that the ground will be processed using a reduced quantity of binders and/or products which modify the mechanical performance, such as fibres.

The stated objective of the invention is to provide a simple method and a simple device for introducing fibrous additives and adding them to the constituent materials of the ground.

In document EP-B-0,285,622, it is proposed to strew the ground with chopped fibres and to proceed with mixing in various manners. The quantities of fibres introduced range from 0.1 to 5% by weight. In this document, it is sought to improve the ground as far as the following characteristics are concerned: resistance to shear, total internal friction angle, mean total cohesion and finally mean initial tangent modulus. No method is proposed therein for uniformly spreading chopped fibres on the ground. As far as the final mixing operation is concerned, simply the techniques therefor are mentioned.

The stated objective of the invention is to provide a method complete with all the elements allowing implementation, the results of which are assured, particularly as regards the stability of the fibrous additives content, which makes it possible for these to be kept at a low level, with good effectiveness.

In Patent Application PCT/FR94/00643 filed on Jan. 6, 1994, a technique is described for incorporating into existing ground bundles of glass fibres which have been cut from rovings of threads, immediately before they are deposited on the ground. This technique uses a device which includes a machine for chopping continuous threads installed on moving plant and a system for spreading the chopped threads transversely with respect to the travel of the plant as well as site equipment of the milling cutter type, its travel and that of the chopping machine being linked or unlinked.

The advantage of chopping the rovings of textile glass threads directly just before distributing is to guarantee a precise proportion of bundles of filaments in the granulous mixture. The roving-chopping machines like those in document EP-B-0,040,145 actually drive them at a defined speed (the tangential speed of the rollers) and since the quantity of bundles introduced during a given time is therefore always the same, all that is required is for the speed of travel of the machine relative to the ground or the throughput of granules to be constant—as is generally the case—for the percentage of bundles of filaments to remain stable. It is also possible to slave the speed of rotation of the rollers of the chopping machine either to the speed of travel, or, if it is immobile, to the throughput of the conveyor so as then again to guarantee the stability of the percentage of bundles.

For its part, the present invention seeks also to allow the use of chopped and stored threads, which are then to be extracted evenly from the stock and distributed uniformly.

From document FR-A-2,699,945 there is also known a technique for distributing fibrous additives on a road in which technique a box structure containing a certain volume of already chopped fibres is installed at the back of a lorry, the dump body of which contains gravel. The box structure containing the fibres ends in a chute which conveys the fibres so that they are mixed with the flow of gravel leaving the box structure; a rotary roller intended to allow the even outflow of the chopped fibres is provided at the entry to the chute.

Apart from the fact that the foregoing system mixes the fibres and gravel together as a matter of course, which is not always desired, this type of machine deals with the distributing of fibrous additives over the entire width of a roadway, and requires an installation and particularly a roller of a prohibitive length.

SUMMARY OF THE INVENTION

The invention aims to provide a method and a device which allow fibrous additives added to the materials of the ground to be distributed and mixed together, and which do not suffer from the drawbacks of the previous systems.

The invention proposes a method for reinforcing the materials already in place in the ground by the addition in particular of fibrous additives, including the following steps:

- opening up the surface to render the materials to be reinforced accessible, if they were not so already,
- if necessary, breaking up the said materials,
- depositing an even layer of previously chopped fibrous additives,
- mixing together the materials to be reinforced and the fibrous additives until a proportion by weight of 0.01% to 0.50% is obtained.

For preference, the method uses fibrous additives which are reinforcing glass fibres in the form of bundles chopped to a length of 3 to 500 mm. Advantageously, the bundles of fibres have been chopped at the place where they are produced, immediately after they have been formed, and before any winding operation.

With these materials, the fibrous additives can be distributed without difficulty, which is not the case when chopping takes place from threads held together in rovings end wound.

In a variant of the method of the invention, the fibrous additives are glass fibres or rock fibres obtained by centrifuging, and packaged in the form of nodules by being passed through a holed plate. This preparation of the insulating fibres makes them easy to use in the method according to the invention.

The invention also relates to a technique for depositing an even layer of fibrous additives on the ground, in which technique use is made of items of equipment intended to distribute pulverulent materials on the roads, especially those designed for treating icy roads with various powders such as antifreeze salts or nonskid powders.

In a variant of the method for distributing the fibres, the bundles of fibres are held together forming a mat, and it is this mat which is shredded and its fragments deposited on the ground or into the materials of the ground.

With this technique, the desired quantity of fibrous additives is automatically deposited in the right place.

The invention also relates to a device for the implementation of the methods it includes, for depositing fibrous additives, a salt spreader using a centrifugal force ejector.

For preference, the latter includes one or more discs of substantially vertical axis rotating in their plane, and onto which the fibrous additives are deposited.

Moreover, the device may, for mixing together the materials to be reinforced and the fibrous additives, include machines from the group including disc ploughs, mouldboard ploughs, pulverizing mixers such as a mixer with horizontal shaft or rotavator.

It may be seen that the device of the invention uses simple and robust means which, as a consequence, are particularly reliable.

BRIEF DESCRIPTION OF THE DRAWINGS

The description and figures which follow will make it possible understand the invention and to grasp its advantages.

DETAILED DESCRIPTION OF THE INVENTION

The method of the invention is usually performed in two steps, the first consists in depositing the fibrous additives on the ground in an even layer and then the second consists in spreading them evenly through the materials of the ground which is worked with suitable plant which fulfils the same function as a simple plough.

It is also possible for this second operation to make use of equipment known as pulverizing mixers which extract the material from the ground, pulverizing it and then reintroduce it after having mixed it, mixing taking place either with the additives deposited on the ground in the first step described earlier (FIG. 1), or with those added at the precise moment when the materials have been extracted from the ground, before they are returned therein. FIG. 3 describes the latter variant, FIG. 2 for its part illustrates the first step of the first variant: the spreading of the fibrous additives over the ground, and FIGS. 4 and 5 the phase in preparation of this first step.

Figure 1:
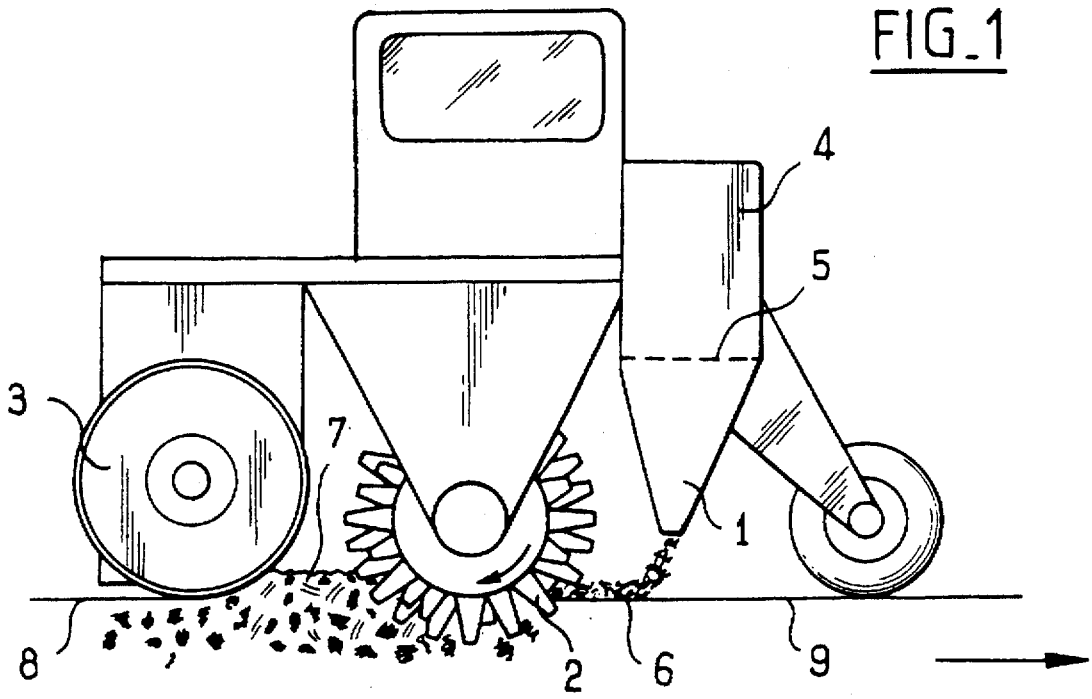
FIG. 1 shows plant which simultaneously evenly distributes the stored fibrous additives and mixes them with the materials of the ground, FIG. 2 an independent system for spreading the fibrous additives on the ground, and FIG. 3 complete plant which uses rolls of fibre mats, shreds them and deposits them on the ground then mixes the fragments together with the materials of the ground.

In FIG. 1 can be seen self-propelled plant which includes three essential elements, a distributor of fibrous additives 1, an extractor/pulverizer roller 2, and finally a compressor roller 3.

The fibre dispenser 1 is composed of two parts, the first, at the top, is a fibre reservoir 4 which here contains bundles of filaments cut from threads of reinforcing glass fibres (glass E), each thread being 25 tex, the diameter of the constituent filaments being 11 μm, that is to say that each thread had 48 elemental filaments. The length of the sections of bundles was 12 mm. At the bottom of the fibre reservoir, at the level marked 5 in the figure, there is an extractor device. Such a device has to fulfil two functions, extracting the fibres while preventing them from becoming jammed at the bottom of the reservoir, and metering the throughput of fibres. Several devices allow these two functions to be fulfilled, one of them includes a vibrating grid situated at the bottom of the reservoir, which surmounts a series of parallel Archimedean screws with horizontal axes, the speed of rotation of which defines the throughput. Upon leaving the Archimedean screws the fibres are spread evenly across the entire width of the machine, perpendicularly to the plane of the figure. While the self propelled plant advances along the ground, it thus deposits a carpet 6 of fibres of even thickness thereon.

When the extractor/pulverizer 2 penetrates the ground and turns it over, mixing it, it at the same time mixes together the fibres and the materials of the ground reduced to powder.

The quantity of fibres which should be introduced depends on the improvement which is to be obtained. If mechanical properties alone are at question, if the bearing capacity in general is to be improved, then very low quantities are sufficient. Excellent results are obtained with contents of between 0.01 and 0.10%.

In contrast, as described in Patent Application PCT/FR94/00643 filed on Jan. 6, 1994, the teaching of which application is incorporated into the present application, to increase the cracking of ground into which a waterbased binder has been added, it may be necessary to increase the proportion of fibres up to contents of 2 or even 5 kg/tonne (0.20 or 0.50%) and also, the results are better in general with longer fibres, ones 25 mm or more long.

The last operation carried out by the automotive plant of FIG. 1 is rolling. The compressor roller 3 presses down the loosened materials 7 and brings the level of the ground 8 to the height which it had before the beginning of the work at 9.

Depending on the nature of the ground and its final use, it may be necessary in addition to the fibrous additives, to add other materials, various binders or correcting sand, for example. In this case, these will preferably be deposited on the ground in the same way as the fibres.

The self-propelled plant of FIG. 1 combines into one and the same machine the devices which make it possible to carry out the two operations of the method of the invention: even spreading of the fibres and mixing together with the loosened materials of the ground. In addition, the rolling carried out afterwards instantly. finishes off the work. However, it is clearly possible to perform all these operations independently, each time with suitable plant.

Thus, to spread the fibrous additives on the ground, use can advantageously be made of the machines usually intended to spread on icy roads either antifreeze salts, or nonskid powders (sands of defined particle size, possibly heated).

Figure 2:
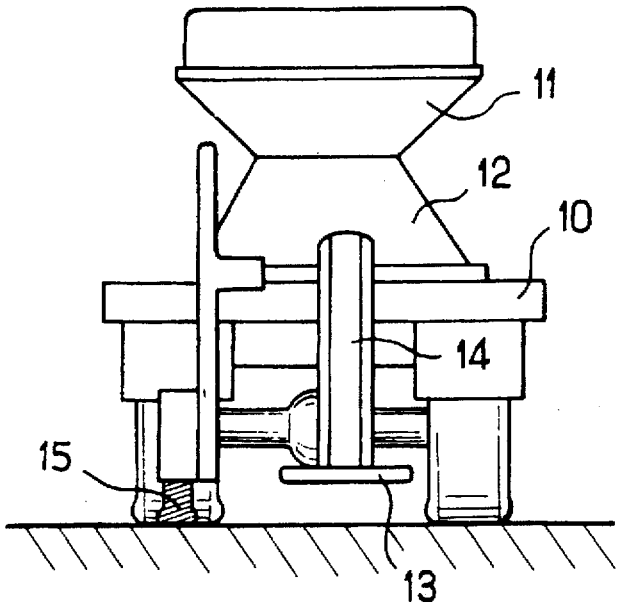
Figure 3:
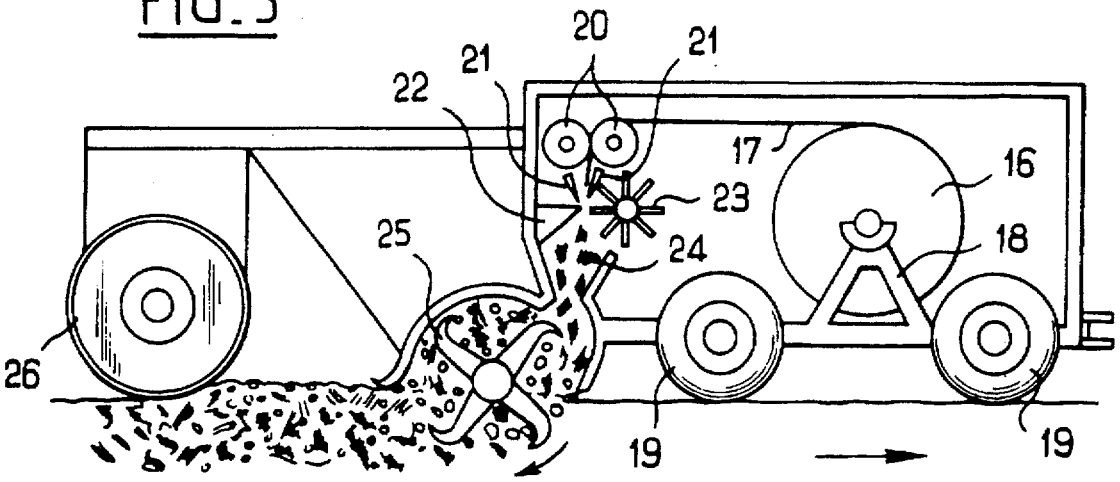

FIG. 2 thus represents a centrifugal salt spreader. The bed 10 of a lorry can be seen, on which bed there is placed a fibre reservoir 11 with, underneath, its extractor/throughput regulator 12. The latter feeds an inclined chute, not represented, which deposits the fibres on a horizontal disc 13 borne by a vertical spindle 14 and given a rapid rotational movement. As the lorry advances, it is important for the throughput of the extractor/throughput regulator devices to be matched to the speed of advancement. This is why a wheel 15 makes it possible to drive the extractors directly or at least record the speed of advancement so that extraction can be proportional thereto. Thus, regardless of the speed of the lorry, it is contrived for the quantity of fibrous additives spread on the ground to remain constant. The speed of rotation of the disc is, for its part, adjusted to obtain the desired width of depositing.

Trials carried out with a BUCHER high-capacity salt spreader, with a 5 $m^3$ reservoir filled with STABI-FIL (diameter of the filaments: 14 μm) chopped to 12 mm, allowed fibres to be spread uniformly over a width of 8 m. In the case of the site in question, there was question of incorporating the fibres into the materials of the ground to a depth of 20 cm, and for mixing it was possible to use a trailed disc plough which produces very satisfactory mixing over this depth in a single pass. The content of fibres, uniformly spread through the ground was, at the end of the operation, 0.02%. Using STABI-FIL, such a content provides a bearing capacity, cohesion, and moisture stability which are entirely satisfactory.

When the depth to be processed is greater, the disc plough becomes ineffective and a mounted mouldboard plough or pulverizing mixing plant of the type of that in FIG. 1 should be used.

The previous salting plant with horizontal disc was also used for dispersing over the ground not reinforcing glass fibres but insulating glass fibres. These were fibres originating from mats of glass wool shredded and reconstituted into nodules in accordance with the method of Patent EP-B-0, 455,553. After shredding a mat, this involves passing the tufts through a "nodule-forming machine" where, with the aid of knives, the fibres are forced to pass through a plate equipped with holes 6 to 15 mm in diameter. The nodules, just like the chopped reinforcing fibres, are dispersed perfectly well using the salt spreader of FIG. 2.

FIG. 3 shows a different way of adding the chopped fibres into the loosened materials of the ground. It differs in two ways from the methods already described, through the form in which the fibres are presented and through the way in which the fibres are incorporated.

The fibres are presented in the form of a glass mat, that is to say that the continuous or chopped fibres therein are held together and bound to form a carpet 17 which is packaged in the form of a roll 16. The self-propelled plant of FIG. 3 is equipped with a roller holder 18 supported by the front wheels 19. The mat 17 is driven by the rollers 20 at a speed which is linked to the speed of advancement of the vehicle. It is actually the ratio between these two speeds which defines the concentration of fibrous additives relative to the materials of the ground. Visible at 21, 22 and 23 is the known mechanism which allows the mat to be shredded and to get back to the constituent fibres held together in bundles which are to be introduced into the ground. The difference in the introduction of the fibres as compared with the foregoing one lies in the fact that here the bundles of fibres 24 are not deposited on the ground as before but introduced directly into the loosened materials by the vane-wheel extractor 25. Once the materials have been put back in place, the compressor roller 26 flattens the ground again and brings it back to its previous level.

Within the context of the invention, provision is also made for the mat of glass fibres described hereinabove insofar as it consists of chopped fibres to be deposited directly on the ground and for plant intended to loosen the soil and/or to mix in the fibrous additives to work on the mat and incorporate its components where it lies.

Figure 4:
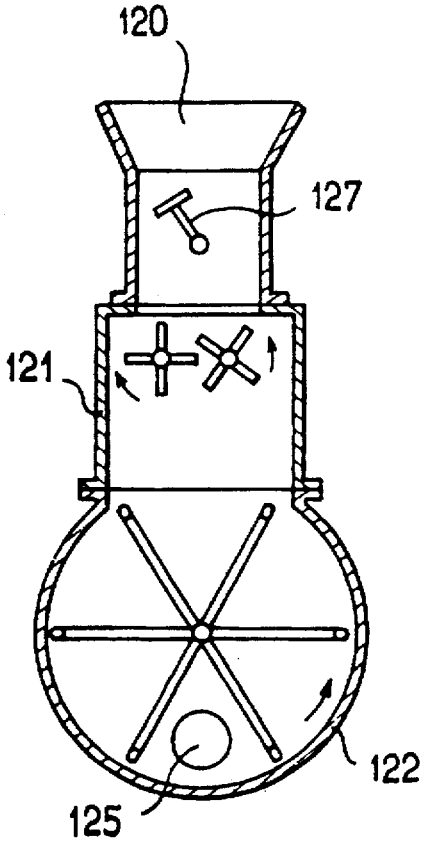
FIGS. 4, 5*a* and 5*b* deal with a device for extracting the fibrous additives from their stock and giving them a constant throughput.

To make it easier to separate and to meter the bundles of fibres, use has also been made of another device represented in FIGS. 4 and 5. This is a device for pneumatic transportation end decompacting which is fed with the fibres via a hopper 120. The device like the one described in French Patent 2,557,817 represented in FIG. 4 essentially includes a clump separator 127 preceding a carding device 121 which feeds a gating valve 122 and it includes a turbine, not represented, with controlled throughput which supplies the orifice 125 with the air necessary to transfer the fibres.

Figure 5A:
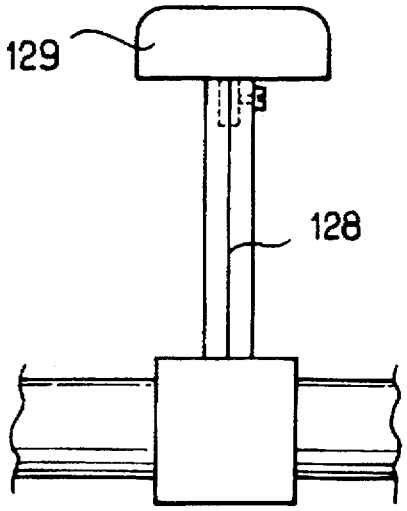
Figure 5B:
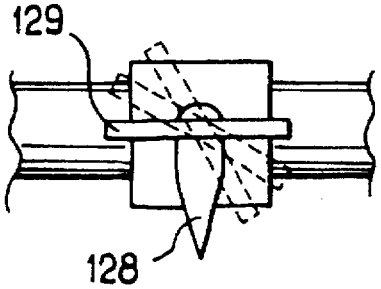
Figure 6:
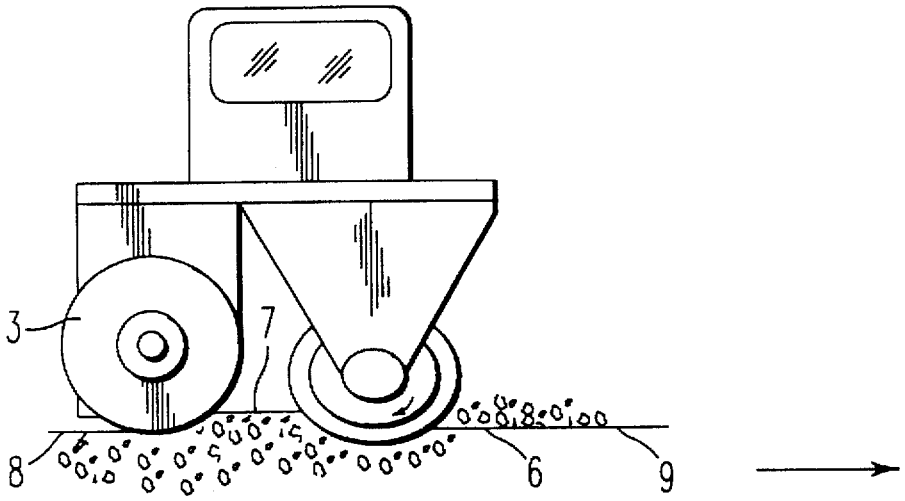
FIGS. 6 and 7 show the disc plow and moldboard plow of the invention, respectively. Reference numerals are the same as for FIGS. 1–5. See FIG. 1 for the pulverizing mixer.
Figure 7:
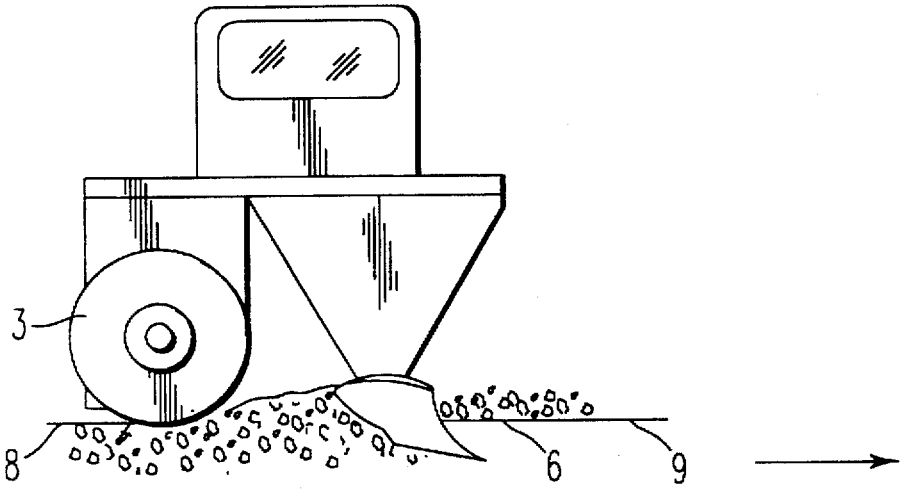
Figure 8:
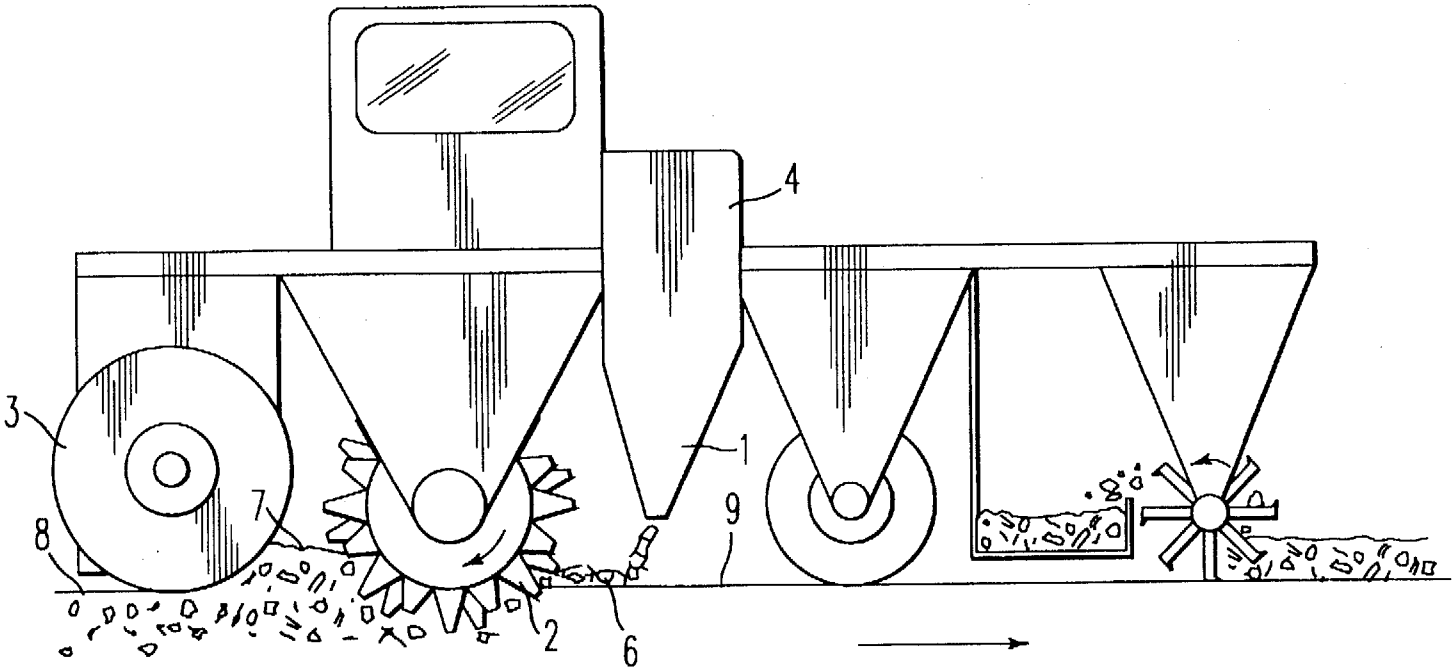
FIGS. 8 and 9 show plants similar to that shown in FIG. 1 further capable of opening up the surface of the ground (FIG. 8) and of breaking up materials to be reinforced (FIG. 9). See FIGS. 1–5 for reference numerals.
Figure 9:
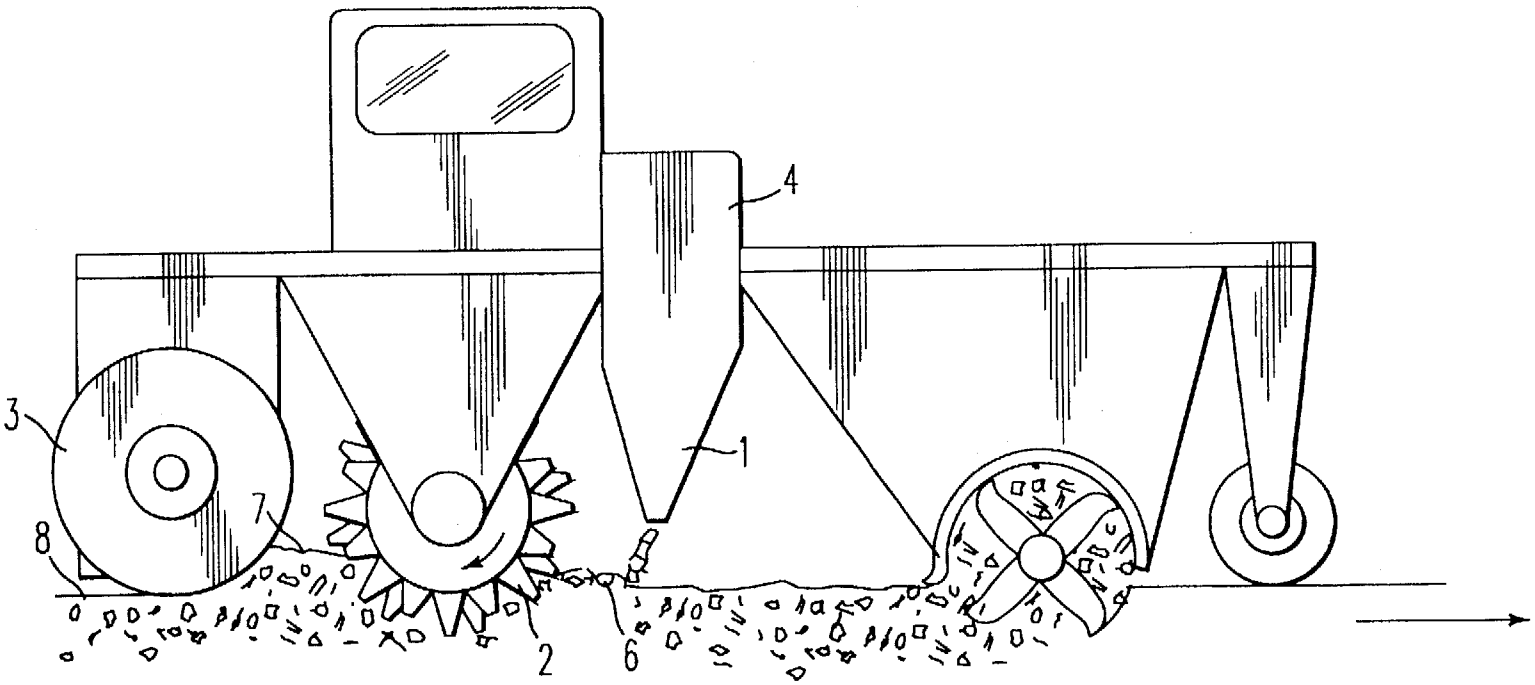

The fibrous materials may be introduced in loose form, for example by virtue of a silo situated above the device. The imbrication of the compressed fibres is important end this is why it has been found useful to replace the blades of the clump separator 127 by two different elements, on the one hand a cutting arm 128 (FIG. 5) which serves as a knife and is capable of chopping the agglomerations of fibres by virtue of its cutting edge oriented in the plane of its trajectory and, on the other hand, at the end of the knife, a symmetric finger 129 perpendicular to the arm which can adopt different orientations in its plane so as either to push the fibres back towards the outlet from the clump separator 127 and direct them towards the carding device 121 or, in contrast, to keep the fibre in the clump separating zone for long enough for the bundles of fibres to separate from one another. FIG. 5*a* is a side view. FIG. 5*b* is a view from above.

The device of FIGS. 4 and 5 thus makes it possible uniformly to feed a system for spreading fibrous additives, such as the salt spreader of FIG. 2. The throughput of fibres is defined by the speed of rotation of the knives 127 of FIG. 4 and therefore of the gating valve which carries out the volumetric metering.

For the clarity of the explanation, FIGS. 1 and 3 represent the various phases of the method of the invention carried out in a single piece of plant, but it is clear that they could be implemented independently. Likewise, to combine the method phases extracted from different examples would not be departing from the method of the invention.

Thus, for example, the mat of FIG. 3, its distributor and its shredder may be replaced by the distributor of fibrous additives 1 of FIG. 1 which fulfills the same function, that of distributing stored bundles of fibres, storage in the form of a mat simply being replaced by storage in the loose form.

In all the trials in which cut bundles of reinforcing glass fibres which are stored in the loose form have been used, an ease of use has been observed which is much greater in the case where the threads were diechopped immediately after the filaments had been gathered together to constitute a thread. By comparison, the bundles of fibres chopped from rovings tended to form bunches of fibres that the extractor devices situated at the exit from the fibre reservoirs had difficulty in separating.

The method and the devices described earlier make it possible to incorporate precisely metered and well spread fibrous materials into the ground to be treated. This metering and this spreading make it possible to make best use of the performance provided by the fibrous additives, particularly by the bundles of reinforcing glass fibres. Thus, with quantities as low as those lying between 0.01 and 0.10%, the ground is given very good mechanical performance, whereas with greater contents which may reach and even exceed 0.50%, ground containing a water-based binder is afforded a very substantial improvement, and even disappearance of cracking phenomena.

We claim:

1. A method for reinforcing materials already in place in the ground, comprising the steps of:

depositing onto the surface of the materials to be reinforced an even layer of fibrous additives, and mixing together the materials to be reinforced and the fibrous additives, wherein said fibrous additives are selected from the group consisting of glass fibers in the form of bundles having a length of from 3 to 500 mm, glass fibers obtained by centrifuging and packaging in the form of nodules by passing through a holed plate, and rock fibers obtained by centrifuging and packaging in the form of nodules by passing through a holed plate.

2. The method of claim 1, wherein said materials to be reinforced and fibrous additives are mixed together to provide a proportion by weight of said additives of from 0.01% to 0.50%.

3. The method of claim 1, wherein said materials to be reinforced and said fibrous additives are mixed together to provide a proportion by weight of said additives of at least 0.01%.

4. The method of claim 1, wherein said fibrous additives are glass fibers in the form of bundles having a length of from 5 to 500 mm, and wherein said bundles are formed by forming glass into bundles of fibers which are not wound but cut into chopped bundles where they are produced immediately after having been formed.

5. The method according to claim 4, wherein said fibrous additives are glass fibers in the form of bundles, and wherein said fibrous additives are deposited onto the surface of the materials to be reinforced by equipment intended to distribute pulverulent materials on roads and designed for treating icy roads with powders.

6. The method of claim 1, wherein the even layer of fibrous additives is deposited onto the ground by means of items of equipment intended to distribute pulverulent materials on roads.

7. The method of claim 1, wherein said fibrous additives are glass fibers in the form of bundles, wherein said method further comprises a prior step of providing said glass fibers in the form of bundles by shredding a mat of said bundles, and wherein the depositing step comprises depositing said bundles onto the surface of the materials to be reinforced.

8. The method of claim 1, wherein said fibrous additives are deposited by means of a salt spreader using a centrifugal force ejector.

9. The method according to claim 8, wherein said salt spreader includes at least one disk of substantially vertical axis rotating in their plane, and onto which the fibrous additives are deposited.

10. The method according to claim 1, wherein said mixing step is accomplished with a machine selected from the group consisting of disk plows, moldboard plows, and pulverizing mixers.

11. The method according to claim 1, wherein said fibrous additives are glass fibers in the form of bundles, and wherein said fibrous additives are deposited onto the surface of the materials to be reinforced by equipment intended to distribute pulverulent materials on roads and designed for treating icy roads with powders.

12. The method of claim 1, further comprising a prior step of opening up the surface of the ground to render the materials to be reinforced accessible, and wherein said depositing step comprises depositing the fibrous additives onto the opened surface of the materials to be reinforced.

13. The method according to claim 1 comprising a prior step of breaking up the materials to be reinforced, and wherein said depositing step comprises depositing the fibrous additives onto the surface of the broken up materials.

14. The method of claim 13, wherein said fibrous additives are glass fibers in the form of bundles provided by shredding a mat of said bundles.

* * * * *